US009510104B2

(12) United States Patent
Onishi

(10) Patent No.: US 9,510,104 B2
(45) Date of Patent: Nov. 29, 2016

(54) ELECTROACOUSTIC TRANSDUCER, MANUFACTURING METHOD THEREFOR, AND ELECTRONIC DEVICE UTILIZING SAME

(71) Applicant: NEC CASIO MOBILE COMMUNICATIONS, LTD., Kawasaki-shi, Kanagawa (JP)

(72) Inventor: Yasuharu Onishi, Kawasaki (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 14/647,899

(22) PCT Filed: Dec. 2, 2013

(86) PCT No.: PCT/JP2013/082326

§ 371 (c)(1),
(2) Date: May 28, 2015

(87) PCT Pub. No.: WO2014/087961

PCT Pub. Date: Jun. 12, 2014

(65) Prior Publication Data

US 2015/0304780 A1 Oct. 22, 2015

(30) Foreign Application Priority Data

Dec. 3, 2012 (JP) ..... 2012-264526

(51) Int. Cl.
*H04R 17/00* (2006.01)
*H04R 31/00* (2006.01)
(Continued)

(52) U.S. Cl.
CPC ..... *H04R 17/00* (2013.01); *B06B 1/064* (2013.01); *B06B 1/0614* (2013.01); *H04R 17/10* (2013.01);
(Continued)

(58) Field of Classification Search
CPC ..... H04R 2440/00–2440/07; H04R 17/02; H04R 1/00; H04R 2205/022; H04R 2201/401; H04R 2201/405; H04R 2217/00–2217/03
USPC ..... 381/152, 173, 182, 190
See application file for complete search history.

(56) References Cited

U.S. PATENT DOCUMENTS 4,401,857 A * 8/1983 Morikawa ..... H04R 17/00 381/190
4,985,926 A * 1/1991 Foster ..... H04R 17/00 381/190

(Continued)

FOREIGN PATENT DOCUMENTS

JP 63-048479 A 3/1988
JP 09-093696 A 4/1997

(Continued)

OTHER PUBLICATIONS

International Search Report for PCT Application No. PCT/JP2013/082326, mailed on Feb. 10, 2014.

(Continued)

*Primary Examiner* — Suhan Ni

(57) ABSTRACT

An electroacoustic transducer comprises a plurality of layered piezoelectric vibrator units that are arranged side by side in a direction intersecting a vibrating direction, wherein the plurality of layered piezoelectric vibrator units comprise respectively, a plurality of piezoelectric vibrators with different resonance frequencies, arranged in the vibrating direction in layers with a predetermined space therebetween; a plurality of vibrating members that hold the plurality of piezoelectric vibrators respectively; and a frame that supports edges of the plurality of vibrating members, and the plurality of vibrating members are arranged in the vibrating direction in layers with a predetermined space therebetween such that an area of the each of the plurality of vibrating members increases or decreases monotonically in the vibrating direction.

6 Claims, 6 Drawing Sheets

(51) Int. Cl.
*B06B 1/06* (2006.01)
*H04R 17/10* (2006.01)
*H04R 1/40* (2006.01)

(52) U.S. Cl.
CPC ..... *H04R 31/00* (2013.01); *H04R 1/403* (2013.01); *H04R 2217/03* (2013.01); *H04R 2499/11* (2013.01)

(56) References Cited

U.S. PATENT DOCUMENTS 4,996,713 A * 2/1991 Bittencourt ..... H04R 17/00 381/190
2012/0119617 A1 5/2012 Takahashi et al.
2013/0243224 A1 9/2013 Onishi et al.

FOREIGN PATENT DOCUMENTS

JP 2003-061194 A 2/2003
JP 2012-029110 A 2/2012
WO 2012/060041 A1 5/2012

OTHER PUBLICATIONS

Extended European Search Report for EP Application No. EP13859861.0 dated Jun. 3, 2016.

* cited by examiner

ELECTROACOUSTIC TRANSDUCER, MANUFACTURING METHOD THEREFOR, AND ELECTRONIC DEVICE UTILIZING SAME

REFERENCE TO RELATED APPLICATION

The present invention is based upon and claims the benefit of the priority of Japanese patent application No. 2012-264526, filed on Dec. 3, 2012, the disclosure of which is incorporated herein in its entirety by reference thereto.

This application is a National Stage Entry of PCT/JP2013/082326 filed on Dec. 2, 2013, which claims priority from Japanese Patent Application 2012-264526 filed on Dec. 3, 2012, the contents of all of which are incorporated herein by reference, in their entirety.

TECHNICAL FIELD

The present invention relates to an electroacoustic transducer, a manufacturing method therefor, and an electronic device utilizing same.

BACKGROUND

In recent years, a parametric speaker with high directivity to provide sound to a person at a particular position is getting attention. It is expected that the parametric speaker is mounted on an electronic device, such as, a mobile phone, etc to provide a sound signal around a user, etc.

Here, when the parametric speaker is mounted on the electronic device, for example, a mobile phone, etc., it is desired to miniaturize the parametric speaker. However, it is difficult in principle to miniaturize an electro-dynamic electroacoustic transducer with a magnetic circuit. Therefore, it is expected to use an electroacoustic transducer using a piezoelectric vibrator.

In Patent Literatures 1 to 3, there is disclosed an electroacoustic transducer that comprises a plurality of piezoelectric vibrators that are arranged side by side in a direction toward a direction of sound wave emission.

[Patent Literature 1]
Japanese Patent Kokai Publication No. 2003-061194A
[Patent Literature 2]
Japanese Patent Kokai Publication No. 1997-093696A
[Patent Literature 3]
Japanese Patent Kohyo Publication No. 1988-048479A

SUMMARY

The disclosure of the above Patent Literatures is incorporated herein by reference thereto. The following analysis has been given by the present invention.

As described above, it is expected to use an electroacoustic transducer using a piezoelectric vibrator. Here, it is desired that the parametric speaker transmits an ultrasonic waves in a wide frequency band in order to realize output of sounds with high sound quality. Further, when the parametric speaker is mounted on an electronic device such as a mobile phone, it is desired to miniaturize the parametric speaker.

However, it is necessary for the electroacoustic transducer to comprise a plurality of piezoelectric vibrators in order to oscillate the ultrasonic waves with a wide frequency band.

Further, when the electroacoustic transducer comprises a plurality of piezoelectric vibrators, ultrasonic waves transmitted from the piezoelectric vibrators may interfere.

Namely, when the electroacoustic transducer comprises a plurality of piezoelectric vibrators, a directivity may decrease.

In the techniques disclosed in Patent Literatures 1 to 3, it is possible that ultrasonic waves transmitted from the piezoelectric vibrators interfere each other. Therefore, the directivity of emitted sound waves decreases as a number of piezoelectric vibrators increases.

Therefore, there is a need in the art to contribute to emitting sound waves with a wide frequency band, and preventing decrease of a directivity of transmitted sound waves.

Solution to Problem

According to a first aspect, there is provided an electroacoustic transducer, comprising: a plurality of layered piezoelectric vibrator units that are arranged side by side in a direction intersecting a vibrating direction, wherein the plurality of layered piezoelectric vibrator units comprise respectively: a plurality of piezoelectric vibrators, with different resonance frequencies arranged in the vibrating direction in layers with a predetermined space therebetween; a plurality of vibrating members that hold the plurality of piezoelectric vibrators respectively; and a frame that supports edges of the plurality of vibrating members, and the plurality of vibrating members are arranged in the vibrating direction in layers with a predetermined space therebetween such that an area of each of the plurality of vibrating members increases or decreases monotonically in the vibrating direction.

According to a second aspect, there is provided an electroacoustic transducer, comprising: a plurality of layered piezoelectric vibrator units that are arranged side by side in a direction intersecting a vibrating direction, wherein the plurality of layered piezoelectric vibrator units comprise respectively: a plurality of piezoelectric vibrators, with different resonance frequencies arranged in the vibrating direction in layers with a predetermined space therebetween; a plurality of vibrating members that hold the plurality of piezoelectric vibrators respectively; and a frame that supports edges of the plurality of vibrating members, and the plurality of vibrating members are arranged in the vibrating direction in layers with a predetermined space therebetween such that an area of each of the plurality of vibrating members increases or decreases monotonically in the vibrating direction, and causing the piezoelectric vibrators to oscillate such that an ultrasonic wave(s) having a frequency of 20 kHz or higher is emitted.

According to a third aspect, there is provided a manufacturing method of an electroacoustic transducer that comprises a plurality of piezoelectric vibrators and a plurality of vibrating members holding the plurality of piezoelectric vibrators, comprising: arranging the plurality of piezoelectric vibrators with different resonance frequencies in a vibrating direction in layers with a predetermined space therebetween; arranging a plurality of layered piezoelectric vibrator units side by side in a direction intersecting the vibrating direction, wherein the plurality of layered piezoelectric vibrator units, respectively, comprising the plurality of piezoelectric vibrators arranged in layers, and the plurality of vibrating members; and arranging the plurality of vibrating members in the vibrating direction in layers with a predetermined space therebetween such that an area of each of the plurality of vibrating members increases or decreases monotonically in the vibrating direction.

According to each aspect of the present invention, an electroacoustic transducer contributing to emitting sound waves with a wide frequency band, and preventing of decrease of directivity of the emitted sound waves and a manufacturing method thereof, and an electronic device utilizing the same are provided.

PREFERRED MODES

First, a summary of an exemplary embodiment of the present invention will be given using FIG. 1. Note that drawing reference signs in the summary are given to each element for convenience as examples solely for facilitating understanding, and the description of the summary is not intended to suggest any limitation.

As described above, oscillation of ultrasonic waves with a wide frequency band is desired in order to realize to output sounds with high sound quality. However, as the number of piezoelectric vibrators increases, the directivity of emitted sound waves may decrease. Therefore, it is desired an electroacoustic transducer that contributes to transmitting sound waves with a wide frequency band, and preventing decrease of a directivity of transmitted sound waves.

Figure 1:
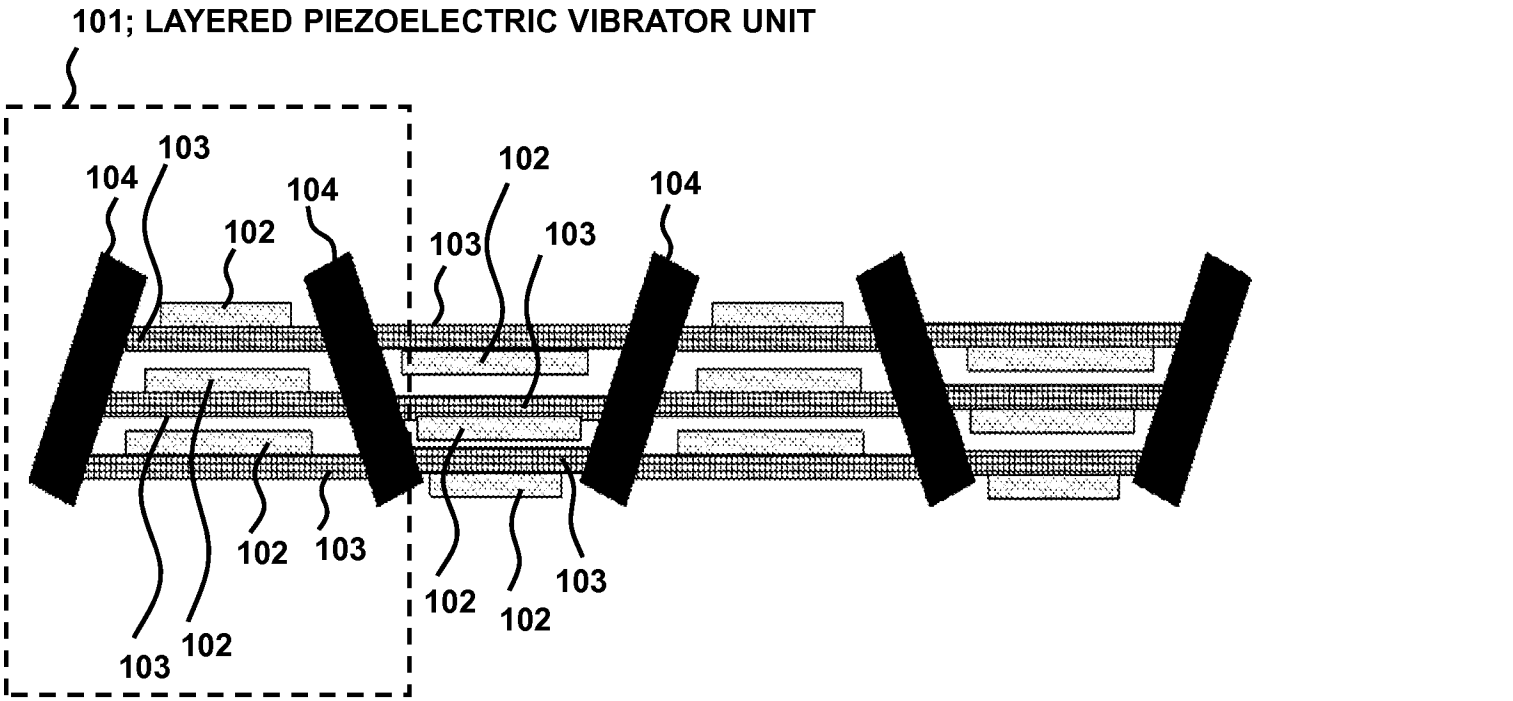
FIG. 1 is a drawing for explaining an exemplary embodiment.

An electroacoustic transducer 100 shown in FIG. 1 is provided as an example. The electroacoustic transducer 100 comprises layered piezoelectric vibrator units 101 that are arranged side by side in a direction intersecting a vibrating direction of a piezoelectric vibrator 102. The layered piezoelectric vibrator units 101 comprise a plurality of the piezoelectric vibrators 102, vibrating members 103 and frames 104. The vibrating members 103 restrain the piezoelectric vibrators 102. The frames 104 restrain an edge of vibrating members 103. The vibrating members 103 are arranged in the vibrating direction of the piezoelectric vibrators 102 in layers with a predetermined space therebetween such that areas of the vibrating members 103 increase or decrease monotonically.

In each of layered piezoelectric vibrator unit 101, the piezoelectric vibrators 102 are arranged in the vibrating direction in layers with a predetermined space therebetween. Further, in FIG. 1 shows the layered piezoelectric vibrator unit 101 that comprises the piezoelectric vibrators 102 with three layers. But, this is not aim to limit that the piezoelectric vibrators 102 are arranged in three layers. The piezoelectric vibrators 102 may be arranged in two layers or more than four layers.

The piezoelectric vibrators 102 vibrates by application of an electric field to transmit sound waves. Here, layered piezoelectric vibrator units 101 comprise a plurality of piezoelectric vibrators 102 that have different resonance frequencies. Therefore, by demodulating ultrasonic wages transmitted from the piezoelectric vibrators 102 with different resonance frequencies, it is possible to expand a band of demodulated audible sounds.

For example, the layered piezoelectric vibrator units 101 may comprise the piezoelectric vibrators 102 with different lengths. There is a relationship of inverse proportion between the resonance frequencies of sound waves transmitted from the piezoelectric vibrators 102 and length of the piezoelectric vibrators 102. Therefore, by changing each length of piezoelectric vibrators 102, it is possible to change the resonance frequency of each piezoelectric vibrator 102.

Further, it is preferred that the electroacoustic transducer 100 selectively drives one or more of the piezoelectric vibrators 102. By driving the piezoelectric vibrator(s) 102 selectively, it is possible to improve a directivity of the electroacoustic transducer 100. Namely, by driving the piezoelectric vibrator 102 selectively, it is possible to form a sound field in a particular direction. Therefore, the electroacoustic transducer 100 contributes to emitting sound waves with a broadband, and preventing decrease of directivity of the emitted sound waves.

And, as described above, vibrating members 103 are arranged in the vibrating direction of the piezoelectric vibrators 102 in layers with a predetermined space therebetween such that areas of the vibrating members 103 increase or decrease monotonically. Therefore, the frames 104 that support the edges of the vibrating members are arranged with an inclination. By inclining frames 104 in this way, it is possible to release stresses against the frames 104.

Further, as shown in FIG. 1, it is preferred that the vibrating members 103 are arranged an arrangement order of which is opposite to the vibrating members 103 that of provided inside the adjacent layered piezoelectric vibrator unit 101. Because, by arranging the vibrating members in such a way, it is possible to decrease an implementation volume of the electroacoustic transducer.

Further, in FIG. 1, an arrangement order of the vibrating members 103 and the piezoelectric vibrators 102 in a layered piezoelectric vibrator unit 101 is opposite to that in an adjacent layered piezoelectric vibrator unit 101. However, in the adjacent layered piezoelectric vibrator units 101, the piezoelectric vibrators 102 may be arranged on a same side of a surface of the vibrating members 103. And, in the layered piezoelectric vibrator units 101, the piezoelectric vibrators 102 may be arranged on both sides of surfaces of the vibrating members 103. Namely, the layered piezoelectric vibrator units 101 may be configured with, so-called, a bimorph structure.

In the present invention, the following modes are available.

[Mode 1]

As the electroacoustic transducer relating to the first aspect.

[Mode 2]

It is preferred that an arrangement order of the plurality of vibrating members in a layered piezoelectric vibrator units is opposite to that of the plurality of vibrating members in an adjacent layered piezoelectric vibrator unit.

[Mode 3]

It is preferred that the plurality of layered piezoelectric vibrator units comprise the plurality of vibrating members different in at least one of stiffness and thickness respectively.

[Mode 4]

It is preferred that the electroacoustic transducer drives selectively one or more of the plurality of piezoelectric vibrator(s).

[Mode 5]

It is preferred that the plurality of vibrating members comprise a vent.

[Mode 6]

As the electronic device relating to the second aspect.

[Mode 7]

As the manufacturing method relating to the third aspect.

[Mode 8]

It is preferred that the manufacturing method comprises arranging the plurality of vibrating members in a layered piezoelectric vibrator unit, an arrangement order of which is opposite to that of the vibrating members in an adjacent layered piezoelectric vibrator unit.

[Mode 9]

It is preferred that the manufacturing method comprises arranging the plurality of vibrating members in layers in the plurality of layered piezoelectric vibrator units, wherein the plurality of vibrating members have at least one of different stiffness and different thickness respectively.

[Mode 10]

It is preferred that the manufacturing method comprises forming a vent that goes through the plurality of vibrating members.

A concrete exemplary embodiment will be described below in more detail with reference to the drawings.

Exemplary Embodiment 1

A first exemplary embodiment will be described in more detail with reference to the drawings.

At first, a basic structure of an electroacoustic transducer 1 relating to the present exemplary embodiment will be described.

Figure 2:
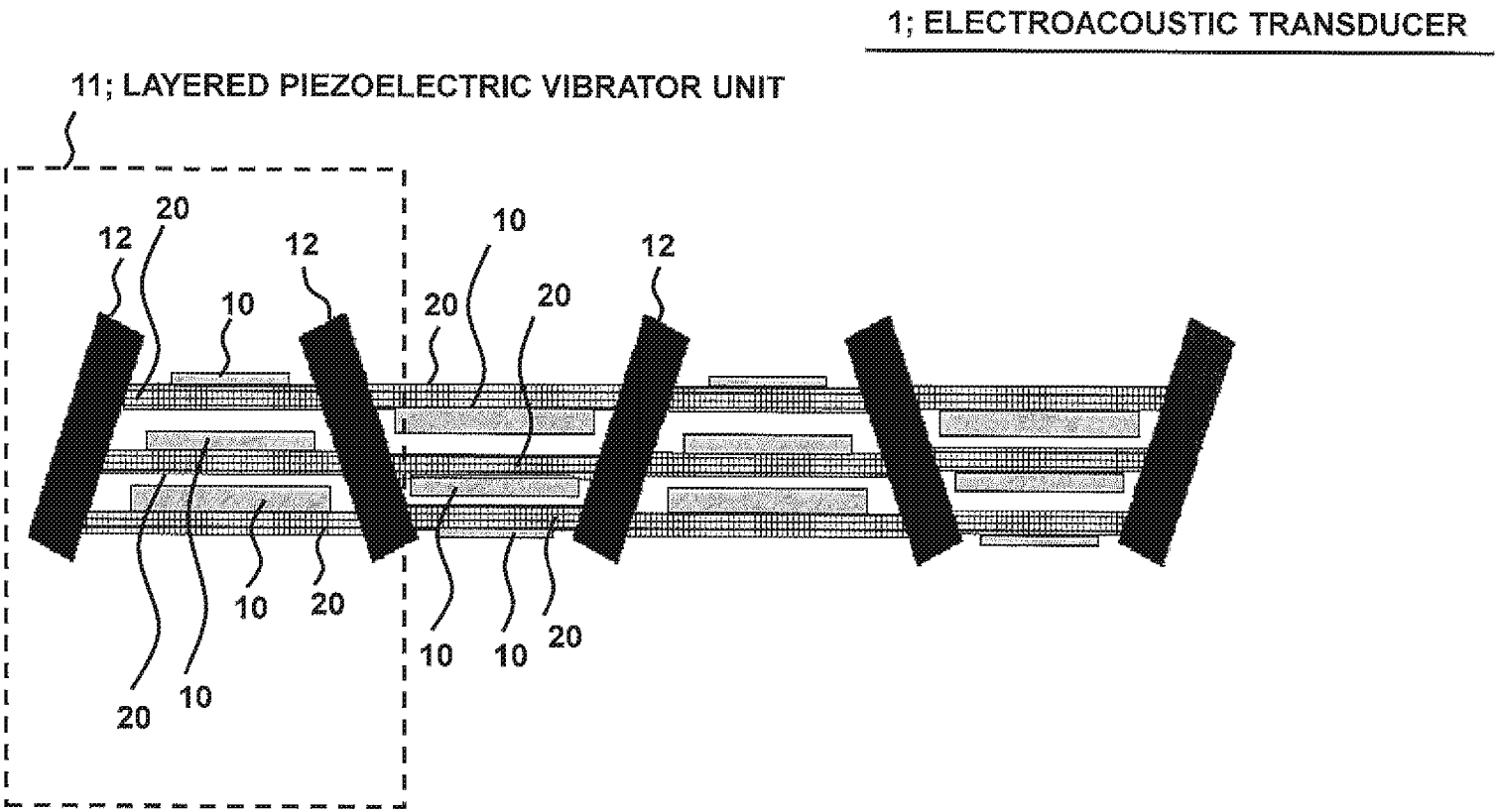
FIG. 2 is a drawing of showing an example of a basic structure of an electronic device 2 relating to an exemplary embodiment 1.

FIG. 2 is a drawing of a sectional side view showing an example of the electroacoustic transducer 1 relating to the present exemplary embodiment. Further, for simplicity, FIG. 2 only shows members relevant to the electroacoustic transducer 1 relating to the present exemplary embodiment.

For example, the electroacoustic transducer 1 is used as a speaker apparatus. As the speaker apparatus, the electroacoustic transducer 1 may be a parametric speaker. When the electroacoustic transducer 1 is used as the parametric speaker, it is preferred that a piezoelectric vibrator 10 transmits ultrasonic waves with a frequency of 20 kHz or higher. In this case, the parametric speaker transmits sound signals using ultrasonic waves as carrier waves. And, the parametric speaker induces collision waves accompanying nonlinear phenomenon of air by emitting modulated ultrasonic waves toward atmosphere, and reproduces demodulated sound waves.

Further, transmitting of ultrasonic waves with high straightness by piezoelectric vibrators 10 makes it possible to form a sound field with high directivity. As a result, the electroacoustic transducer 1 relating to the present exemplary embodiment can emit sound waves in the vicinity of a user.

It is preferred that the electroacoustic transducer 1 is a sound source such as, for example, a smart phone, a mobile phone, a game device, a tablet PC (Personal Computer), laptop, and PDA (Personal Data Assistant).

The piezoelectric vibrator 10 is configured by a piezoelectric substance 21 polarized in a direction toward thickness, and is restricted by a vibrating member 20. The piezoelectric vibrator 10 vibrates by application of an electric field to transmit sound waves. Therefore, it is preferred that an electronic device with the electroacoustic transducer 1 comprises an oscillating circuit (not shown in the drawings) that generates electric signals to be applied to the piezoelectric substance 21.

The electroacoustic transducer 1 comprises layered piezoelectric vibrator units 11 that are arranged side by side in a direction intersecting a vibrating direction of the piezoelectric vibrators 10. The layered piezoelectric vibrator unit 11 is configured to include a plurality of the piezoelectric vibrators 10 and frames 12. Each of the piezoelectric vibrators 10 is arranged being restricted by the plane-shaped vibrating member 20. The piezoelectric vibrators 10 are arranged in a vibrating direction in layers with a predetermined space therebetween. Further, the layered piezoelectric vibrators 10 are held via the frames 12 that support an edge of the vibrating member 20.

An arrangement order of the vibrating members 20 and the piezoelectric vibrators 10 in a layered piezoelectric vibrator unit 11 may be opposite to that of the vibrating members and the piezoelectric vibrators in an adjacent layered piezoelectric vibrator unit 11. For example, when the piezoelectric vibrator 10 is restrained on a top side of the vibrating member 20 in one layered piezoelectric vibrator unit 11, another piezoelectric vibrator 10 may be restricted on a bottom side of another vibrating member 20 in another layered piezoelectric vibrator unit 11 that is adjacent on a plane to the above one layered piezoelectric vibrator unit 11. Otherwise, the piezoelectric vibrator may be arranged on both sides of the vibrating member 20.

Figure 3:
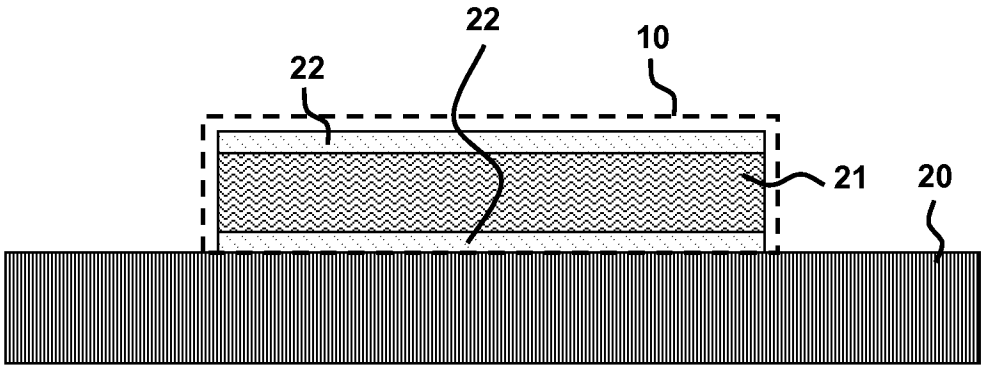
FIG. 3 is a drawing of a sectional side view showing an example of the piezoelectric vibrator 10 relating to the exemplary embodiment 1.

FIG. 3 is a drawing of a sectional side view showing an example of the piezoelectric vibrator 10. For simplicity, FIG. 3 only shows members relevant to the piezoelectric vibrator 10 relating to the present exemplary embodiment.

Electrodes 22 are restricted on both sides of a piezoelectric substance 21. Namely, the piezoelectric substance 21 is polarized in a direction toward thickness. A material(s) composing the piezoelectric substance 21 is a material(s) with piezoelectric effect, and may be an inorganic material(s) or an organic material(s). For example, they may be a piezoelectric ceramic which is, for example, a lead zirconate titanate, a barium titanate, etc. Further, there are various materials preferable for the piezoelectric substance 21, but details of the materials preferable for the piezoelectric substance 21 are not limited.

And, a material(s) composing the electrode 22 is not limited, and may be, for example, a silver and a silver/palladium. The silver has a low electrical resistance, and is used as a generic electrode material. The silver/palladium has a low electrical resistance, furthermore, has a high resistance for oxidation. Further, there are various materials preferred for electrodes, but details of the materials preferred for the electrodes are not limited.

Now, as described above, it is preferred that the piezoelectric substance 21 is a piezoelectric ceramic, but the piezoelectric ceramic is brittle. That is why, in the case that the piezoelectric substance 21 is composed by the piezoelectric ceramic, it is difficult to change a shape of the piezoelectric substance 21. Therefore, it is preferred to change a resonance frequency by changing a thickness, materials, etc. of vibrating member 20 which restricts the piezoelectric substance 21.

It is preferred that the vibrating member 20 has a high rigidity against the piezoelectric substance 21. In the case that a rigidity of the vibrating member 20 is too low or too high, it is possible to reduce a characteristic or reliability as a mechanical vibrator. For example, the vibrating member 20 may be composed of a metallic material(s) such as a phosphor bronze, stainless, etc. The vibrating member 20 may be a composite material of a metallic material and a resin. As a result of making the vibrating member 20 be composed of the composite material of the metallic material and the resin, it is possible to arrange the rigidity of the vibrating member 20. There are various materials preferred for the vibrating member 20, but details of the material preferred for the vibrating member 20 are not limited.

Figure 4:
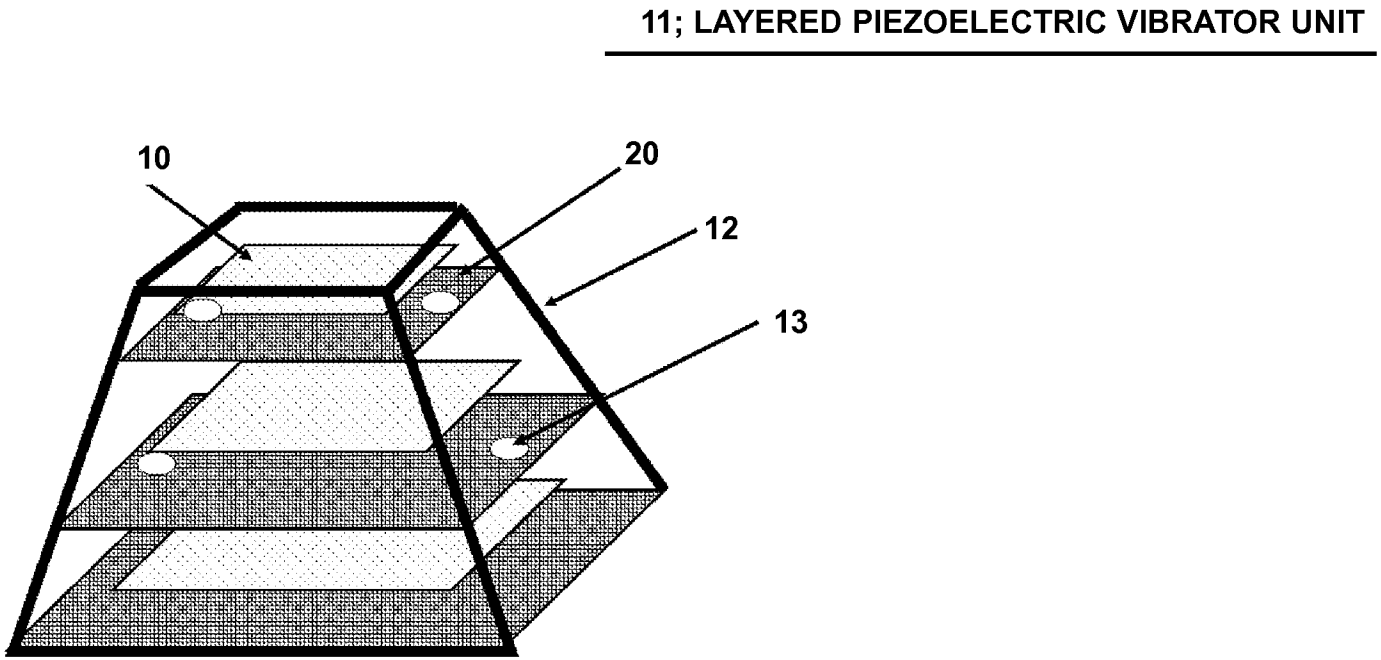
FIG. 4 is a drawing of a perspective view of showing an example of a basic structure of a layered piezoelectric vibrator unit 11 relating to the exemplary embodiment 1.

FIG. 4 is a drawing of a perspective view of showing an example of a basic structure of layered piezoelectric vibrator unit 11.

The material(s) composing the frame 12 is not limited if the material(s) has a high rigidity. The material(s) composing the frame 12 may be a metallic material, an organic material, etc. For example, the material(s) composing the frame 12 may be a stainless, brass, etc.

And, it is preferred that the vibrating member 20 comprises a vent(s). Sound waves transmitted from each of the piezoelectric vibrators 10 are emitted to atmosphere via the vent(s) 13. Concretely, it is preferred that the vibrating members 20 arranged at the front side of the oscillating direction of the adjacent piezoelectric vibrator 10 comprise the vent(s) 13. Note that any position, any size of an area and any number of the vent(s) 13 can be allowed. Preferably, it is preferred that, for each of the vibrating members 20, total sizes of the area of the vent(s) 13 is about 10% of a size of an area of the vibrating member 20.

And, it is preferred that the layered piezoelectric vibrator unit 11 comprises the vibrating members 20 that have either different stiffnesses or different thicknesses. A resonance frequency of the vibrating member 20 increases as the thickness of the vibrating member 20 increases. The resonance frequency of the vibrating member 20 increases as the stiffness of the vibrating member 20 increases. Therefore, it is preferred to arrange the thickness and/or stiffness of the vibrating member 20 such that the resonance frequency assumes a desired value.

Figure 5:
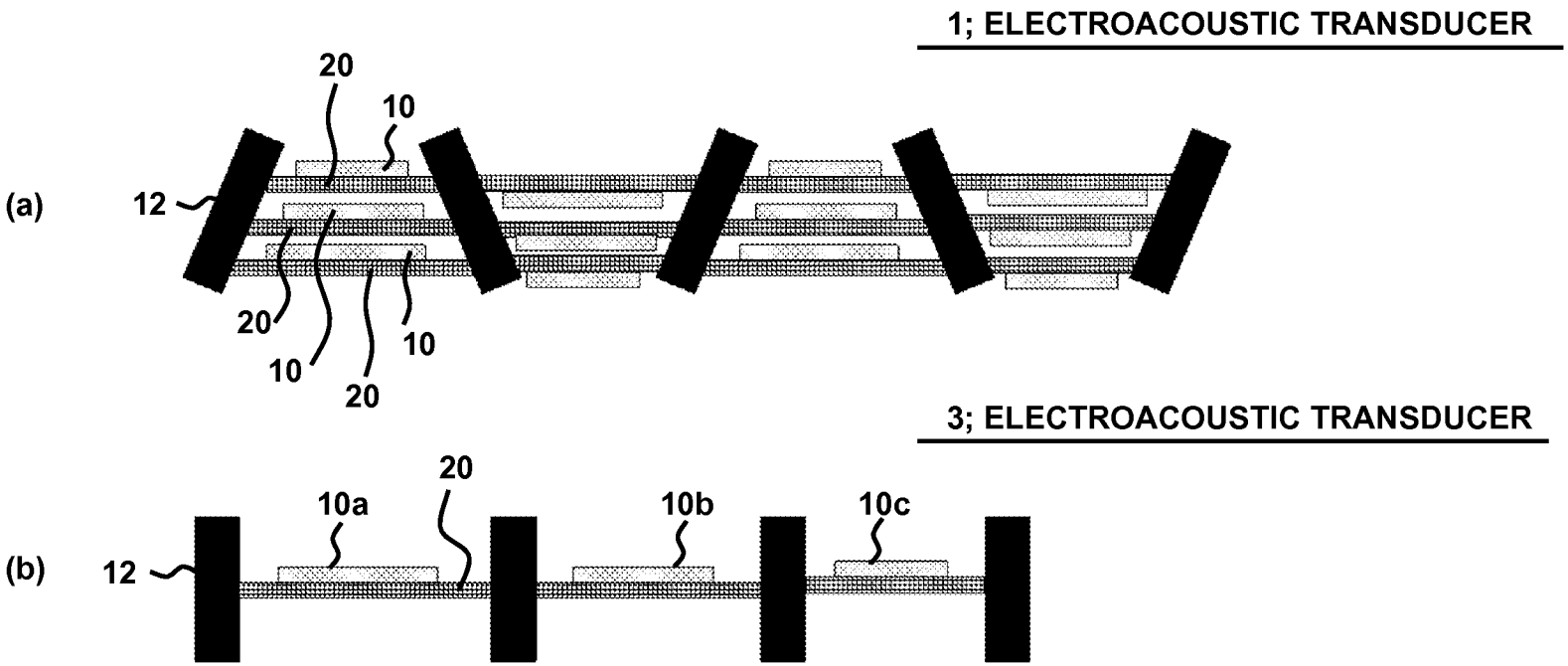
FIG. 5 is a drawing of showing an example of a structure of the exemplary embodiment 1 and a structure of a comparative embodiment.

FIG. 5 is a drawing of showing an example of a comparative structure of a piezoelectric substance 21 and a vibrating member 20. FIG. 5(*a*) is a drawing of showing an example of a structure of the electroacoustic transducer 1 relating to the present exemplary embodiment shown in FIG. 5. On the other hand, FIG. 5 is a drawing of showing an example of a structure of an electroacoustic transducer 3 that does not comprise layers of the piezoelectric vibrators 10. In the following description, the structure of the electroacoustic transducer shown in FIG. 5(*a*) is referred to as a structure of the present exemplary embodiment. On the other hand, the structure of the electroacoustic transducer 3 shown in FIG. 5(*b*) is referred to as a structure of a comparative embodiment.

As shown in FIG. 5(*a*), in the structure of the present exemplary embodiment, the piezoelectric substances 21 restricted by the vibrating members 20 are arranged in three layers along a direction of vibrations of the piezoelectric vibrators 10. On the other hand, in the structure relating to the comparative embodiment, piezoelectric vibrator 10*a* whose lengths is changed are arranged on a plane. Concretely, the piezoelectric vibrator 10*a* corresponds to the piezoelectric vibrators 10 at a bottom layer, in the case that the piezoelectric vibrator 10 is restricted on the top side of the vibrating member 20 in the structure relating to the present exemplary embodiment. And, a piezoelectric vibrator 10*b* corresponds to the piezoelectric vibrator 10 at second layer from a top layer in the structure relating to the present exemplary embodiment. And, a piezoelectric vibrator 10*c* corresponds to the piezoelectric vibrator 10 at the top layer, in the case that the piezoelectric vibrator 10 is restricted on the top side of the vibrating member 20.

Figure 6:
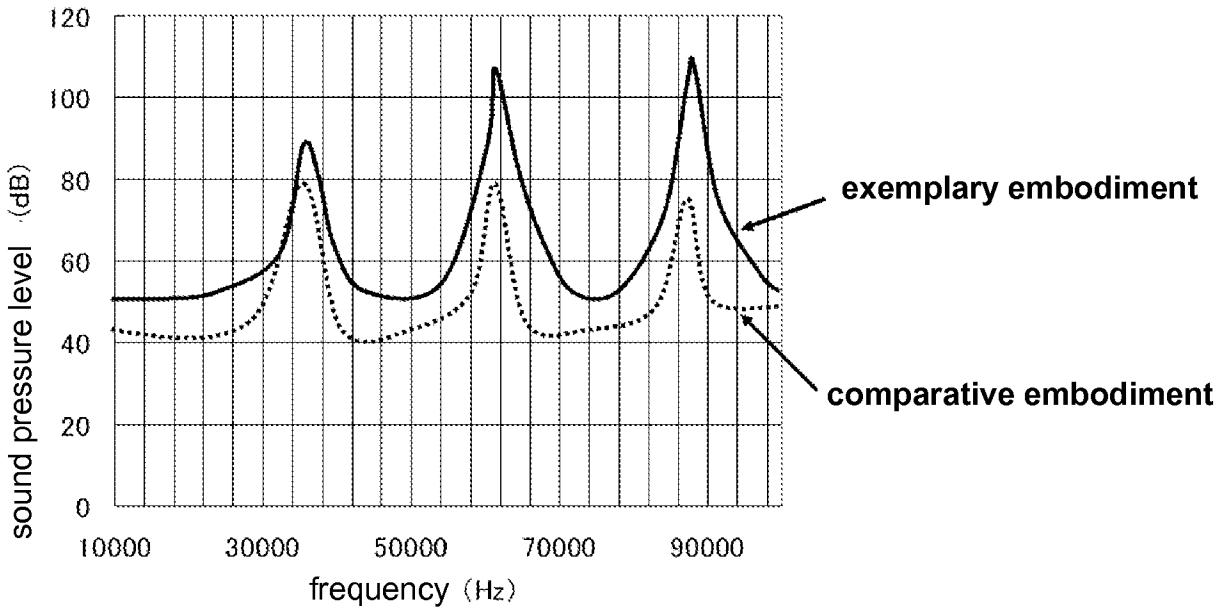
FIG. 6 is a drawing of showing an example of a measurement result of frequency and sound pressure level.

FIG. 6 is a drawing of showing an example of a measurement result of frequency and sound pressure level regarding the structure of the present exemplary embodiment and the structure of the comparative embodiment. Further, in FIG. 6, regarding the structure of the present exemplary embodiment and the structure of the comparative embodiment, it is assumed that physical properties of members in common are same. Furthermore, in FIG. 6, regarding the structure of the present exemplary embodiment and the structure of the comparative embodiment, it is assumed that measurement conditions including temperature etc. are same.

As described above, the structure of the present exemplary embodiment and the structure of the comparative embodiment include the structure of the present exemplary embodiment and the structure of the comparative embodiment with three types of shapes (lengths). Therefore, as shown in FIG. 6, in the structure relating to the present exemplary embodiment and the structure relating to the comparative embodiment, the sound pressure gets peak values on three values of frequencies. Concretely, the sound pressure has peak values around 35 kHz, 60 kHz, and 90 kHz.

Here, over whole of the frequency band shown in FIG. 6, a higher sound pressure value for the structure relating to the present exemplary embodiment than that regarding the structure relating to the comparative embodiment is measured. Therefore, as shown in FIG. 6, the structure relating to the present exemplary embodiment can transmit sound waves with high sound pressure level. Further, FIG. 6 is a drawing showing an example of comparison between a structure relating to the present exemplary embodiment and a structure relating to the comparative embodiment. Therefore, it is reasonable that a frequency, a sound level, etc., in which the sound pressure level has a peak value, change according to a shape of each member, a physical property of each member, and measurement conditions.

A first effect of the electroacoustic transducer 1 relating to the present exemplary embodiment is to contribute to emitting sound waves with a broad band. Because, in the electroacoustic transducer 1 relating to the present exemplary embodiment, the piezoelectric vibrators are arranged in a vibrating direction in layers with a predetermined space therebetween. Further, the electroacoustic transducer 1 relating to the present exemplary embodiment comprises the piezoelectric vibrators that have different resonance frequencies. Hence, the electroacoustic transducer 1 relating to the present exemplary embodiment can demodulate sound signals by a plurality of ultrasonic waves as career waves. Therefore, the electroacoustic transducer 1 relating to the present exemplary embodiment contributes to expanding a band of demodulated sound, and emitting sound waves with a wide frequency band.

A second effect of the electroacoustic transducer 1 relating to the present exemplary embodiment is to contribute to preventing decrease of directivity of emitted sound waves. Because, the electroacoustic transducer 1 relating to the present exemplary embodiment comprises a plurality of piezoelectric vibrators. And, the electroacoustic transducer 1 relating to the present exemplary embodiment can drive the piezoelectric vibrators selectively. Hence, the electroacoustic transducer 1 relating to the present exemplary embodiment can form a sound field toward a particular direction by driving the piezoelectric vibrators selectively. Therefore, the electroacoustic transducer 1 relating to the present exemplary embodiment contributes to preventing decrease of directivity of the emitted sound waves.

The disclosure of each of the above Patent Literatures is incorporated herein by reference thereto. Modifications and adjustments of the exemplary embodiments and examples are possible within the scope of the overall disclosure (including the claims) of the present invention and based on the basic technical concept of the present invention. Various combinations and selections of various disclosed elements (including each element in each claim, exemplary embodiment, example, drawing, etc.) are possible within the scope of the claims of the present invention. Namely, the present invention of course includes various variations and modifications that could be made by those skilled in the art according to the overall disclosure including the claims and the technical concept.

1, 3, 100 electroacoustic transducer
10, 10*a*, 10*b*, 10*c*, 102 piezoelectric vibrator
11, 101 layered piezoelectric vibrator unit
12, 104 frame
13 vent
20, 103 vibrating member
21 piezoelectric substance
22 electrode

What is claimed is:

1. An electroacoustic transducer, comprising:

a plurality of layered piezoelectric vibrator units that are arranged side by side in a direction intersecting a vibrating direction, wherein the plurality of layered piezoelectric vibrator units comprise respectively:

a plurality of piezoelectric vibrators, with different resonance frequencies arranged in the vibrating direction in layers with a predetermined space therebetween;

a plurality of vibrating members that hold the plurality of piezoelectric vibrators respectively; and a frame that supports edges of the plurality of vibrating members, and the plurality of vibrating members are arranged in the vibrating direction in layers with a predetermined space therebetween such that an area of each of the plurality of vibrating members increases or decreases monotonically in the vibrating direction.

2. The electroacoustic transducer according to claim 1, wherein an arrangement order of the plurality of vibrating members in a layered piezoelectric vibrator units is opposite to that of the plurality of vibrating members in an adjacent layered piezoelectric vibrator unit.

3. The electroacoustic transducer according to claim 1, wherein the plurality of layered piezoelectric vibrator units comprise the plurality of vibrating members different in at least one of stiffness and thickness respectively.

4. The electroacoustic transducer according to claim 1, wherein the electroacoustic transducer drives selectively one or more of the plurality of piezoelectric vibrators.

5. The electroacoustic transducer according to claim 1, wherein the plurality of vibrating members comprise a vent.

6. An electronic device comprising:

the electroacoustic transducer according to claim 1; wherein the electronic device causes the piezoelectric vibrators to oscillate such that an ultrasonic wave(s) having a frequency of 20 kHz or higher is emitted.

* * * * *